US010000221B2

(12) United States Patent
Knapp et al.

(10) Patent No.: US 10,000,221 B2
(45) Date of Patent: Jun. 19, 2018

(54) PIT COVER

(71) Applicants: Ryan W. Knapp, Sandy Hook, CT (US); Mark O'Donnell, Danbury, CT (US); Stephen Schumacher, Sandy Hook, CT (US); Thomas Taylor, Watertown, CT (US)

(72) Inventors: Ryan W. Knapp, Sandy Hook, CT (US); Mark O'Donnell, Danbury, CT (US); Stephen Schumacher, Sandy Hook, CT (US); Thomas Taylor, Watertown, CT (US)

(73) Assignee: Macton Corporation, Oxford, CT (US)

( * ) Notice: Subject to any disclaimer, the term of this patent is extended or adjusted under 35 U.S.C. 154(b) by 720 days.

(21) Appl. No.: 14/330,799

(22) Filed: Jul. 14, 2014

(65) Prior Publication Data

US 2016/0009301 A1 Jan. 14, 2016

(51) Int. Cl.

| | |
|---|---|
| ***B66F 7/16*** | (2006.01) |
| ***B61K 13/00*** | (2006.01) |
| *E04H 5/06* | (2006.01) |

(52) U.S. Cl.

CPC ..... *B61K 13/00* (2013.01); *E04H 5/06* (2013.01)

(58) Field of Classification Search

USPC ..... 254/93 L, 89 H, 387; 187/205, 218

See application file for complete search history.

(56) References Cited

U.S. PATENT DOCUMENTS

| | | | | |
|---|---|---|---|---|
| 2,178,632 | A | 11/1939 | Holmes | |
| 2,464,731 | A | 3/1949 | Thompson | |
| 2,577,377 | A | 12/1951 | Snider | |
| 2,593,209 | A | 4/1952 | Smith | |
| 2,594,892 | A * | 4/1952 | Estel, Jr. | B66F 7/16 187/205 |
| 2,655,224 | A | 10/1953 | Hott et al. | |
| 3,608,675 | A | 9/1971 | Sherry | |
| 3,757,898 | A | 9/1973 | Mitchell et al. | |
| 4,508,469 | A * | 4/1985 | Dumortier | E02D 29/14 404/25 |
| 5,404,968 | A * | 4/1995 | Fletcher | B66F 7/14 187/205 |
| 6,244,390 | B1 * | 6/2001 | Yeo | B66F 7/0666 187/205 |
| 2012/0025158 | A1 | 2/2012 | Li et al. | |

* cited by examiner

*Primary Examiner* — Joseph J Hail
*Assistant Examiner* — Shantese McDonald
(74) *Attorney, Agent, or Firm* — St. Onge Steward Johnston & Reens, LLC

(57) ABSTRACT

Disclosed is a pit cover and method of installing the same. The pit cover includes a plate having a hole defining an area. A block having a threaded hole may be affixed to a bottom surface of the plate such that the threaded hole aligns with the area. A support is associated with the foundation and a groove is defined by one of the pit cover or the support. A protrusion is defined by the other one of the pit cover or the support. The groove narrows from a first width towards a second width. The first width is disposed relative to the second width such that insertion of the protrusion into the groove causes an end of the protrusion to pass the first width prior to passing the second width. The protrusion interacts with the groove to align the pit cover at a predetermined position relative to the foundation.

25 Claims, 5 Drawing Sheets

PIT COVER

FIELD OF THE INVENTION

The following invention relates generally pit covers for machinery pits and methods of installing and removing the same. In one application, the pit cover is used for covering a pit associated with rail car machinery such as repair stands and other associated lifting and positioning equipment.

BACKGROUND OF THE INVENTION

Pits are found in many factories and repair shops to contain machinery. Often the pit is defined by a foundation that provides support and a rigid platform to secure the machinery to. There are numerous types of equipment that will typically include a section below shop floor or ground level. Often, these sections include foundations or pits that the machinery is secured to. Some examples of machinery include turntables, car hoists, truck hoists, drop tables and other machinery. For example see application Ser. Nos. 13/804,886, 13/826,001, 14/085,489, 14/139,163 and 14/267,217, the content of which is incorporated herein by reference, for examples of some types of rail shop equipment.

The size of the pit is determined by a number of factors. One of these factors includes the amount of machinery or structure that needs to be contained within the pit due to the particular requirements of the lifting device. In some cases, the lifting device will include fixed rails and moving supports that contact a rail car body. In this case, the fixed rails need to be properly supported. Thus, many pits will include a support structure therein. This support structure takes up space in the pit and thus, in order to accommodate the machinery, motors, gearboxes etc. associated with the machinery, the pit needs to be large enough to accommodate both the machinery and the fixed rails.

In addition, installation and removal of the pit cover is often a difficult task. Often, the pit cover is made on-site out of sheet metal and is cut and fit to the foundation such that the pit cover aligns properly to cover the pit. Often, the fitting of the pit cover to the pit makes the initial installation a difficult and time consuming process. In addition, because the tolerances for how the pit cover is aligned with the pit are not controlled by computer controlled machinery, removal and re-installation of the pit cover after repair of the machinery is often a difficult task.

Further, many pit covers include a threaded hole in the sheet metal for attaching anchors to the pit cover. These anchors allow for the connection of chains, lifting straps and the like to the pit cover so that the pit cover can be removed. Often, the thickness of the pit cover means that very few threads engage the anchor. Therefore, over time, the threaded hole can become worn, causing a safety concern.

Therefore, there is a need to provide an improved pit cover that may do one or more of: eliminate or reduce the fixed rail support structure inside the pit and provide better tolerances and guides for installation, removal and re-installation of pit covers and provide safer connections between lifting devices and pit covers for improved safety.

SUMMARY OF THE INVENTION

Therefore it is an object of the present invention to provide pit cover that requires less space for support structures and at the same time is easier and safer to align for installation and removal.

It is yet another object of the present invention to provide an alignment and support system for the pit cover that improves installation tolerances as well as the process of removal and re-installation of the pit cover after repair or other work is done to the machinery.

Yet another object of the invention is to provide a secure anchor attachment point for the pit cover to improve safety when installing, removing and re-installing the pit cover.

These and other objects are achieved by providing a plate having a hole defining an area. A block having a threaded hole therein may be affixed to a bottom surface of the plate such that the threaded hole aligns with the area. A support may be associated with the foundation and a groove is defined by one of the pit cover or the support. A protrusion is defined by the other one of the pit cover or the support. The groove narrows from a first width towards a second width and the second width is less than the first width. The first width is disposed relative to the second width such that insertion of the protrusion into the groove causes an end of the protrusion to pass the first width prior to passing the second width. The protrusion interacts with the groove such that the protrusion is guided towards a portion of the groove to align the pit cover at a predetermined position relative to the foundation.

In some aspects, the pit cover may further include a shoulder defined at an intersection between first and second sections of the block, the first section of the block having a diameter larger than the second section of the block. The second section of the block may be inserted into the hole such that the shoulder contacts a bottom surface of the plate and wherein a diameter of the hole is larger than the second section of the block but smaller than the first section of the block. The block may be welded to the bottom surface of the plate. In other aspects, the groove includes a first tapered section and a second section, the end of the protrusion fitting in the second section, and the groove may be tapered such that insertion of the protrusion into the groove guides the end of the protrusion towards the second section.

In other aspects the pit cover may include a plurality of support members joined perpendicular to the plate and at least one rail member joined to the plate wherein the support members resist displacement of the at least one rail member. In still other aspects, the pit cover includes a plurality of cover sections each cover section including at least one block and alignment member. One of the plurality of cover sections may include rail sections affixed thereto. In other aspects, a lift hole may be located in the plate. Lifting machinery may be located in the pit and a support of the lifting machinery may pass through the lift hole. In other aspects, the protrusion is located on a support member and a second protrusion may extend from the pit cover. A second support may be affixed to the foundation, the second support defining a vertical section and a horizontal section. An edge of the vertical section may be located at a first distance from an edge of the second section of the groove, where the first distance is approximately equal to or in some cases greater than a second distance measured between the protrusion and the second protrusion such that insertion of the protrusion into the second section of the groove aligns an edge of the protrusion over the horizontal section such that the second protrusion rests on the horizontal section.

Other objects are achieved by providing a pit cover for covering a pit defined by a foundation. The pit cover includes a support associated with the foundation. A groove is defined by one of the pit cover or the support. A protrusion is defined by the other one of the pit cover or the support. The groove narrows from a first width towards a second width and the second width is less than the first width. The first width is disposed relative to the second width such that insertion of the protrusion into the groove causes an end of the protrusion to pass the first width prior to passing the second width. The protrusion interacts with the groove such that the protrusion is guided towards an end of the groove to align at a predetermined position relative to the foundation. At least one rail member is joined to the plate, the rail member receiving a portion of a rail car thereon.

In some aspects the pit cover includes a cover support affixed to a floor of the pit and extending upwards such that a top of the cover support contacts the pit cover when the pit cover is installed in the pit in order to resist displacement of the pit cover. In other aspects a plurality of support members are joined perpendicular to the plate and the support members resist displacement of the at least one rail member. In still other aspects a plurality of support members may be joined perpendicular to the plate, the cover support contacting the plate at the at least one the plurality of support members.

Other objects are achieved by providing a pit cover for covering a pit defined by a foundation. The pit cover may include a plate having a hole defining an area. A block has a threaded hole therein and is affixed to a bottom surface of the plate such that the threaded hole aligns with the area. A plurality of support members are joined perpendicular to the plate and at least one rail member is joined to the plate. The support members provide rigidity for the pit cover and resist displacement of the at least one rail member. A support is associated with the foundation and a groove is defined by one of the pit cover or the support. A protrusion is defined by the other one of the pit cover or the support. The groove narrows from a first width towards a second width and the second width is less than the first width. The first width is disposed relative to the second width such that insertion of the protrusion into the groove causes an end of the protrusion to pass the first width prior to passing the second width. The protrusion interacts with the groove such that the protrusion is guided towards an end of the groove to align the pit cover at a predetermined position relative to the foundation.

In one aspect, the pit cover includes a shoulder defined at an intersection between first and second sections of the block, the first section of the block having a diameter larger than the second section of the block. The second section of the block may be inserted into the hole such that the shoulder contacts a bottom surface of the plate. A diameter of the hole may be larger than the second section of the block but smaller than the first section of the block. In other aspects a second protrusion may extend from the pit cover. A second support may be affixed to the foundation, the second support defining a vertical section and a horizontal section. An edge of the vertical section may be located at a first distance from an edge of the second section of the groove. The first distance may be approximately equal to a second distance measured between the protrusion and the second protrusion such that insertion of the protrusion into the second section of the groove aligns an edge of the protrusion over the horizontal section such that the second protrusion rests on the horizontal section.

In other aspects, an anchor may be threaded into the threaded hole, the anchor further affixed to a lifting device for removing the pit cover from the pit. In other aspects, the pit cover includes a plurality of cover sections each cover section including at least one block. One the plurality of cover sections including the plate and having two rail sections joined thereto.

In other aspects the plurality of cover sections includes three cover sections a first one of said three cover sections may have a first edge adjacent to a first one of said rail sections. A second one of said three cover sections may have a second edge adjacent a second one of said rail sections. In yet other aspects the first and second cover sections may include machinery holes therein, the machinery holes sized such that a support can move through the machinery holes, the support affixed to machinery located in the pit.

Another object is achieved by providing a method of covering a pit defined by a foundation. The method may include one or more steps of: providing a cover; threading an anchor into a threaded hole in a block, the block affixed to the pit cover and disposed below a hole in a plate of the cover, wherein at least part of the block is disposed below a bottom surface of the plate; lifting the cover via the anchor; positioning the cover over the foundation; and installing the cover by lowering the cover such that said cover and the foundation interact to guide the cover towards a pre-determined location relative to a center of the foundation.

In one aspect, the cover and foundation interact via a groove and a protrusion and the groove is attached to one of the cover or the foundation and the protrusion attached to the other one of the cover or the foundation. The groove may narrow from a first width towards a second width wherein the second width is less than the first width and said first width is disposed relative to the second width such that insertion of the protrusion into said groove causes an end of the protrusion to pass the first width prior to passing the second width.

The groove or protrusion that is attached to the foundation may be attached to the foundation via a support. The support may be affixed to a foundation form defining a perimeter wall and a floor such that the foundation form is embedded in the foundation and the foundation contacts the outer surface of the foundation form. The cover may include rail members affixed thereto and spaced apart at a distance to align with a track associated with the pit; and the predetermined location may be disposed relative to the track such that the rail members and the track align when said cover is lowered according to the installing step.

Other objects are achieved by providing a pit cover for covering a pit defined by a foundation, the pit cover including: a plate and a support section defining two opposing surfaces. A first distance and a second distance smaller than said first distance are measured between the two opposing surfaces. An interface section including an end such that when the pit cover is installed on the foundation, the end passes the first distance prior to passing the second distance and the end is disposed between the two opposing surfaces. The interface section is associated with one of the plate or the foundation and the support section is associated with the other one of the plate or the foundation.

In one aspect, the support is be associated with the foundation and the interface section is associated with the plate; and a depth measured between the end and a top surface of the plate is approximately equal to a height measured between a bottom of the support and a top of the foundation. The pit cover may further include a groove where the two opposing surfaces defined by the groove. In one aspect a plurality of support members may be joined to the plate and disposed perpendicular to the plate. At least one of the plurality of support members may define the interfacing section such that the end is defined by a surface of the at least one the plurality of support members. In another aspect, rail members may be joined to the pit cover. In yet another aspect, the plate has a hole defining an area.

A block having a threaded hole therein may be affixed to a bottom surface of the plate such that the threaded hole aligns with the area.

Other objects of the invention and its particular features and advantages will become more apparent from consideration of the following drawings, claims and accompanying detailed description. It should be noted that, while various functions and methods have been described and presented in a sequence of steps, the sequence has been provided merely as an illustration of one advantageous embodiment, and that it is not necessary to perform these functions in the specific order illustrated. It is further contemplated that any of these steps may be moved and/or combined relative to any of the other steps. In addition, it is still further contemplated that it may be advantageous, depending upon the application, to utilize all or any portion of the functions or combinations of functions described herein.

DETAILED DESCRIPTION OF THE INVENTION

Figure 1:
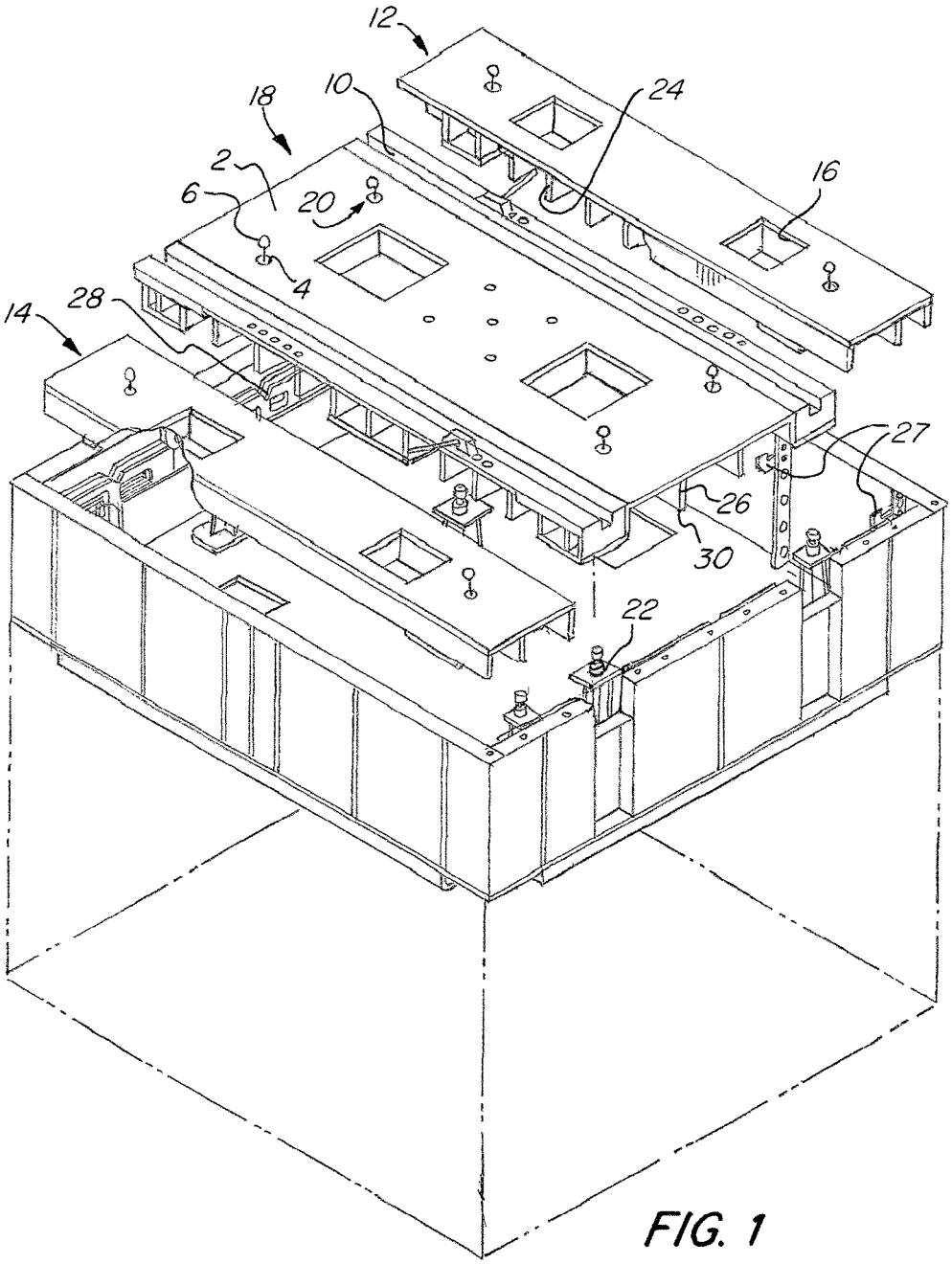
FIG. 1 shows an exploded view of a pit cover according to the present invention.

Referring now to the drawings, wherein like reference numerals designate corresponding structure throughout the views, the following examples are presented to further illustrate and explain the present invention and should not be taken as limiting in any regard.

Figure 8:
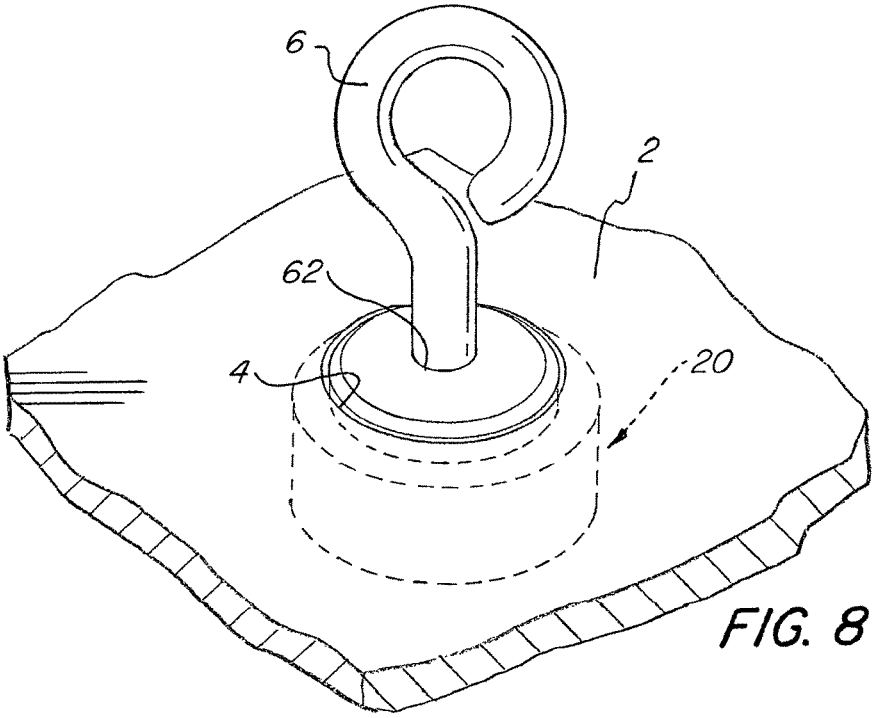
FIG. 8 is a perspective view of the lifting anchor installed in the block according to FIG. 1.

In FIG. 1, a plate 2 includes holes 4. Anchors 6 are threaded into a lifting block which is shown in more detail in FIG. 8. Rails 10 are positioned along the edges of the plate. Alternately, the rails 10 may be spaced apart at a distance corresponding to a standard rail separation distance and side covers 12/14 may be joined to the plate 2 as a single piece. Rails 10 are shown recessed such that the top surface of the rails is approximately level with the top surface of the plate. It is also understood that the rails could rest on top of and be joined to the plate. In the embodiment shown in FIG. 1, side covers 12/14 include machinery holes 16. These holes allow a support plate for the machinery located in the pit to extend through the pit cover.

In the example shown, the particular pit cover is directed to machinery commonly referred to as a car hoist, where lift supports 32 extend through the machinery holes 16 to contact a rail car body above. The wheels or trucks are detached from the body of the rail car and the car hoist lifts the body a distance above the trucks/wheels so that repair can occur or replacement wheels/trucks can be positioned below and attached to the car body. Machinery holes are shown in the side covers 12/14, and there may further be machinery holes within the plate 2 of the center cover 18, depending on the particular machinery being covered.

Side covers 12/14 and center cover 18 have a number of lifting blocks 20 and anchors 6 threaded therein when the pit covers 12, 14, 18 are to be removed from the pit. The pit covers 12, 14, 18 include support members 24 which may extend perpendicular to the plate 2. The protrusion may be considered part of additional support members 26, depending on the positioning of the additional support members 26 relative to the groove 28. The additional support members 26 as shown extend parallel to the rails 10 and provide a support structure for the load on the rails while also providing the protrusion that interacts with grooves 28. The end 30 of the protrusion extends below the plate 2. This protrusion is sized so that it fits into the groove 28 when the pit cover and the groove are properly aligned. A more detailed view of the groove and the groove/protrusion interface is found in FIGS. 3 and 4.

Figure 2:
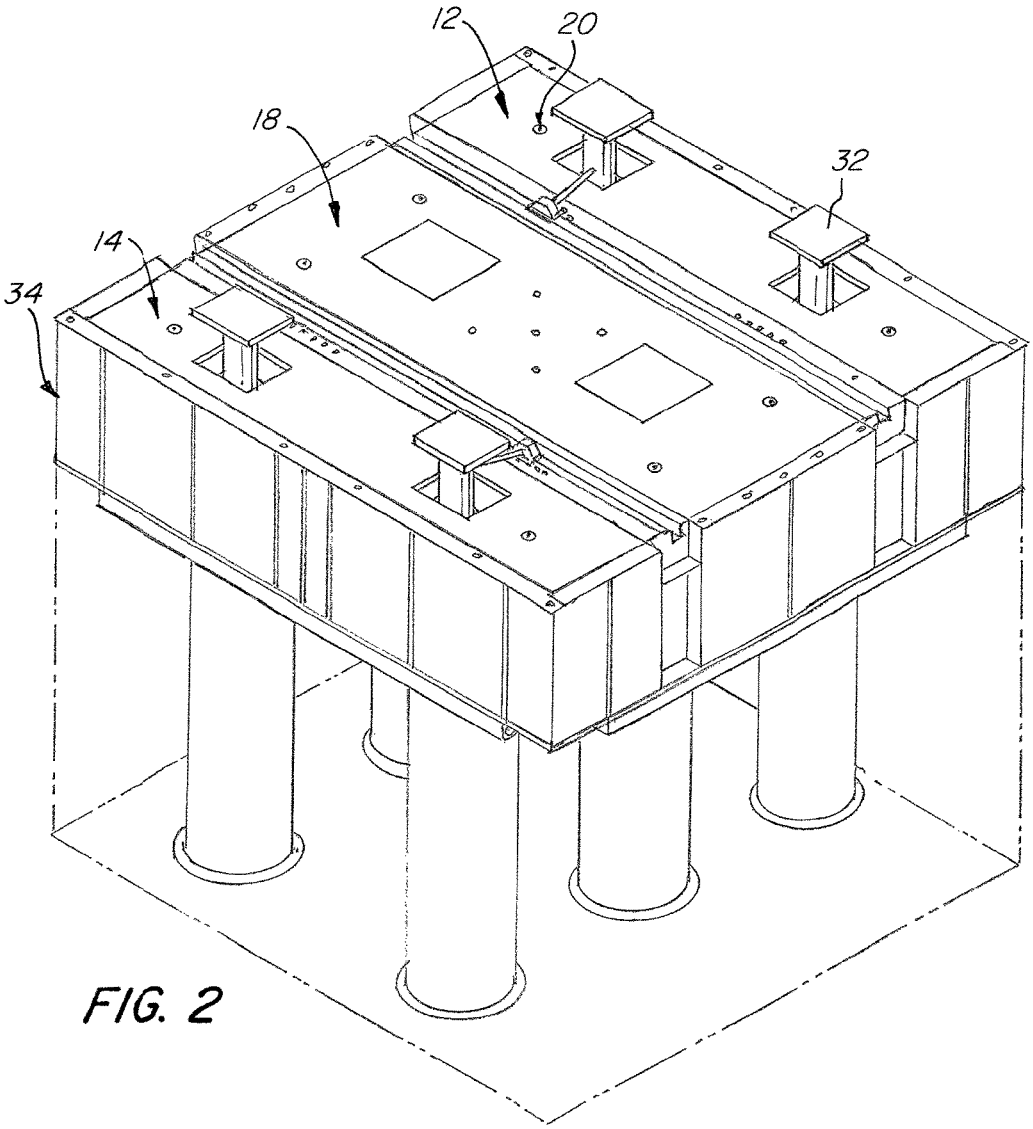
FIG. 2 shows the pit cover of FIG. 1 installed over a machinery pit having machinery installed therein.
Figure 3:
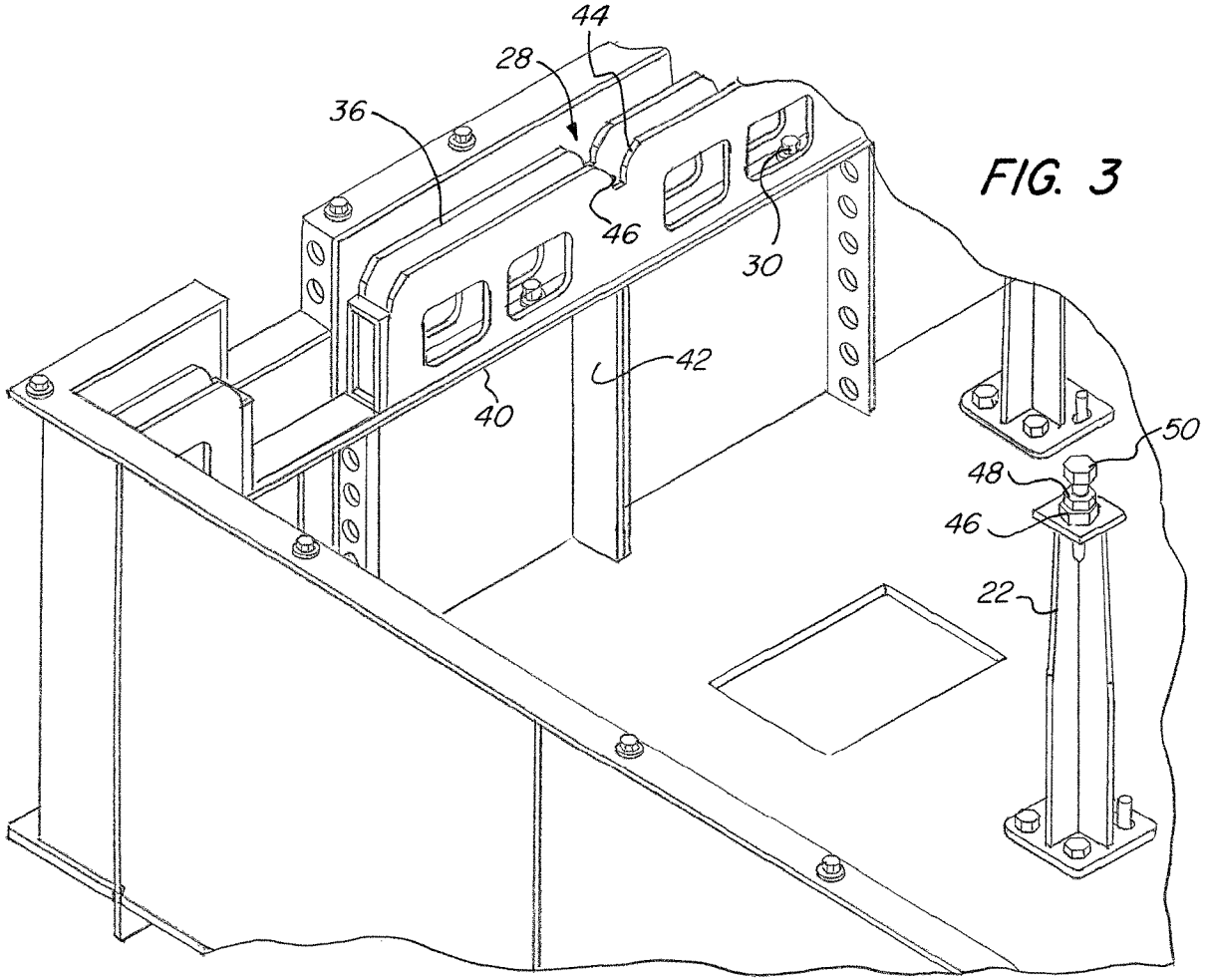
FIG. 3 is a top perspective detail view of the interior of the pit shown in FIG. 1.
Figure 4:
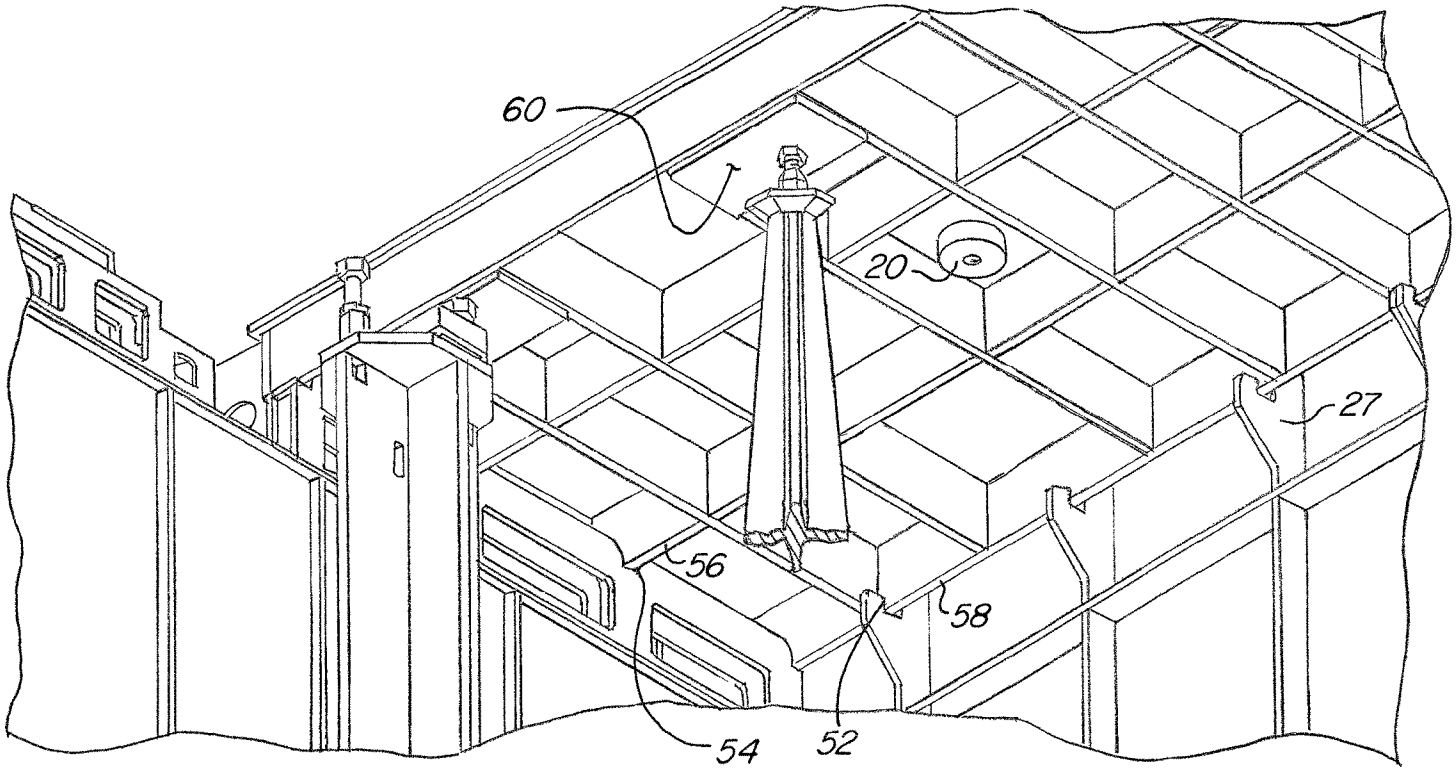
FIG. 4 is a bottom perspective detail view of the interior of the pit shown in FIG. 1.
Figure 5:
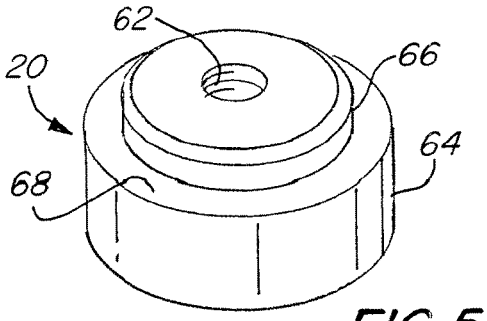
FIG. 5 is a perspective view of the block shown in FIG. 1.
Figure 6:
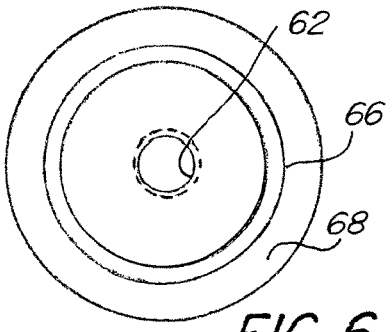
FIG. 6 is a top view of the block shown in FIG. 1.
Figure 7:
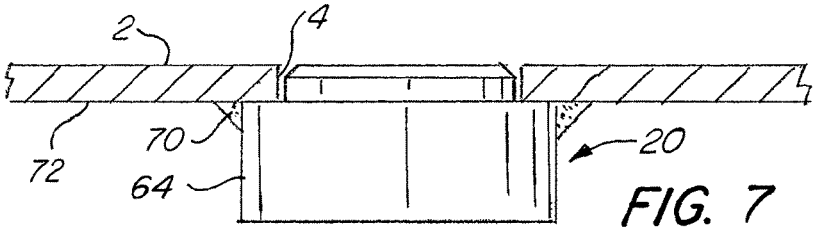
FIG. 7 is a side cutaway view of the block installed in the pit cover of FIG. 1.

In FIG. 2, lifting blocks 20 are shown with the anchors removed and the pit cover sections 12, 14, and 18 installed in the pit. As shown, the pit includes a foundation form 34 embedded in a foundation, however, it is understood that the supports for the pit cover sections 12, 14 and 18 may be attached directly to the foundation in lieu of being attached to the foundation form 34 as shown in FIGS. 1, 3 and 4. In FIG. 3, the support 36 is shown attached to the foundation form 34 and rests on a horizontal support 40. Horizontal support 40 includes holes for receiving bolts 38 therethrough in order to affix the support 36 to the foundation form and thus to the foundation.

Groove 28 includes a first section 44 and a second section 46. First section 44 may be tapered and thus reduces in width or narrows from top towards the bottom. It is also understood that the groove 28 and protrusion 30 may be reversed with respect to the pit cover and foundation. For example, support 36 may include a protrusion 30 extending therefrom. The bottom of the pit cover or cover sections 12, 14, 18 would then include the groove which would narrow from the bottom towards the top. In either case, when the protrusion is inserted into the groove, the protrusion passes the first section and is guided by the taper towards the second section. The protrusion rests in the second section such that the top of the plate is approximately level with floor level of the shop where the machinery may be installed. Also shown in FIG. 3 is a column 32 extending from the floor of the foundation or the foundation embedment form. This column provides additional vertical support to the pit cover sections 12, 14, 18. The column can be adjustable in height. One adjustment mechanism includes a nut 46 or threaded section at the end of the column and bolt 50 having a second nut 48 threaded into the nut 46 that is attached to the column. Loosening of the second nut 48 with respect to the nut 46 allows for rotation of the bolt 50, thereby adjusting the length of the column. Once the desired length is achieved, the second nut 48 is tightened with respect to the nut 46 to lock the adjustment mechanism in place. Although the nut/bolt style adjustment mechanism is shown, one of skill in the art would understand that other adjustment mechanisms may be used. The bolt may rest directly on the bottom surface of the plate 2. In addition, a support plate 60 may be attached to the bottom surface of the plate 2 to provide added rigidity and to more evenly distribute the point load of the column throughout the plate 2.

In FIG. 4, side supports 27 are shown interlocking with a peripheral edge of cover section 12. The side supports 27 include a vertical edge 52 spaced at a first distance from an edge 54 of the groove. As shown, the peripheral edge 58 of cover section 12 that is parallel to the rails 10 is spaced at a second distance from protrusion 56 and the first and second distances are approximately equal. In one embodiment, the first distance may be smaller than the second distance. In addition, the height of edge 52 is less than or equal to the height of second section 46 of the groove such that as the protrusion is guided into alignment, the side supports 27 do not interfere with installation of the pit cover and the pit cover can smoothly slide into proper alignment. As shown, the side supports may be integrally formed into the supports associated with the frame of the foundation embedment form (for example, water jet/plasma/laser cut from the same sheet). It is also understood that the side supports may be separately attached to the foundation or the foundation embedment form, for example by welding, nuts/bolts and others. Also shown in FIG. 4 is the bottom of the lifting block 20 installed in the pit cover.

In FIG. 5-8, the block 20 includes a threaded hole 62 for receiving anchors 6. The block 20 includes first 64 and second 66 sections that define a shoulder 68. The shoulder contacts bottom surface 72 of the plate 2 so that the second section 66 of the block 20 can be inserted into the hole without the block 20 passing all the way through the hole 4. Weld 70 secures the block to the bottom surface 72 of the plate 2. Anchor 6 can thread into the threaded hole 62 such that chains, lifting straps or other similar items may be secured to the pit cover such that the pit cover can be removed and installed using a lifting device.

The protrusion as shown in the figures is disposed generally vertical in relation to the pit cover. It is also contemplated that the protrusion and groove could be designed such that the absolute value of the slope or average slope of the groove may be less than the absolute value of the slope or average slope of the protrusion. With such a design, when the protrusion is located off center or out of alignment with respect to the pre-determined alignment positioning, an end of the protrusion will still be able to insert into the groove with limited or no interference. For example, a portion of the groove could be disposed at a 45 degree angle relative to horizontal and the protrusion could include a surface that is disposed at a steeper angle such as 60 degrees. Thus, a first width of the groove disposed could be measured above a second width assuming the groove is disposed on the support or the foundation. In this case, the first width would be wider than the second width. The end of the protrusion, which may rest on the support may have an end width equal to or slightly smaller than the second width. An intermediate or proximal end width of the protrusion can be measured at a height equal to the separation of the first and second widths. This intermediate or proximal end width would be less than the second width.

The figures also show grooves and protrusions having generally straight edges or surfaces. It is understood that the groove and protrusion could be generally curved in shape or cross section, the protrusion could be designed with a tighter curve in relation to the groove in order to guide in order to guide the pit cover into proper alignment.

The figures have shown the example where the groove within the support and the protrusion extends from the plate/cover. It is understood that the groove could be located in the plate/cover. In this case, the protrusion would extend from the support so that the protrusion and groove can interact to align the pit cover at the appropriate position. It is also understood that the appropriate position of the pit cover as defined by the groove/protrusion interface allows the rails in the pit cover to align with rails entering the pit cover from the shop floor or rail yard.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A pit cover for covering a pit defined by a foundation, the pit cover comprising:

a plate having a hole defining an area;

a block having a threaded hole therein, said block affixed to a bottom surface of said plate such that said threaded hole aligns with said area;

a support associated with the foundation;

a groove defined by one said pit cover or said support;

a protrusion defined by the other one of said pit cover or said support;

said groove narrowing from a first width towards a second width wherein the second width is less than the first width and said first width is disposed relative to the second width such that insertion of the protrusion into said groove causes an end of the protrusion to pass the first width prior to passing the second width;

said protrusion interacting with said groove such that said protrusion is guided towards a portion of said groove to align the pit cover at a predetermined position relative to the foundation.

2. The pit cover of claim 1 further comprising:

a shoulder defined at an intersection between first and second sections of said block, said first section of said block having a diameter larger than the second section of said block;

said second section of said block inserted into the hole such that said shoulder contacts a bottom surface of said plate and wherein a diameter of the hole is larger than the second section of said block but smaller than the first section of said block.

3. The pit cover of claim 2 wherein the block is welded to the bottom surface of said plate.

4. The pit cover of claim 1 wherein the groove includes a first tapered section and a second section, the end of said protrusion fitting in the second section; and wherein the groove is tapered such that insertion of said protrusion into said groove guides the end of said protrusion towards the second section.

5. The pit cover of claim 1 further comprising:

a plurality of support members joined perpendicular to said plate;

at least one rail member joined to said plate wherein said support members resist displacement of said at least one rail member.

6. The pit cover of claim 1 further comprising:

a plurality of cover sections each cover section including at least one block and at least one of said groove or protrusion;

one said plurality of cover sections including rail sections affixed thereto.

7. The pit cover of claim 1 further comprising:

a lift hole located in said plate;

lifting machinery located in said pit and a support of said lifting machinery passing through said lift hole.

8. The pit cover of claim 1 wherein said protrusion is located on a support member joined perpendicular to said plate and the pit cover further comprising:

a second protrusion extending from said pit cover;

a second support affixed to said foundation, said second support defining a vertical section and a horizontal section;

an edge of said vertical section located at a first distance from an edge of said second section of said groove;

the first distance approximately equal to a second distance measured between said protrusion and said second protrusion such that insertion of said protrusion into said second section of said groove aligns an edge of said protrusion over said horizontal section such that said second protrusion rests on said horizontal section.

9. A pit cover for covering a pit defined by a foundation, the pit cover comprising:

a support associated with the foundation;

a groove defined by one said pit cover or said support;

a protrusion defined by the other one of said pit cover or said support;

said groove narrowing from a first width towards a second width wherein the second width is less than the first width and said first width is disposed relative to the second width such that insertion of the protrusion into said groove causes an end of the protrusion to pass the first width prior to passing the second width;

said protrusion interacting with said groove such that said protrusion is guided towards an end of said groove to align at a predetermined position relative to the foundation; and at least one rail member joined to said plate, said rail member receiving a portion of a rail car thereon.

10. The pit cover of claim 9 further comprising:

a cover support affixed to a floor of said pit and extending upwards such that a top of said cover support contacts said pit cover when said pit cover is installed in said pit in order to resist displacement of said pit cover.

11. The pit cover of claim 10 further comprising:

a plurality of support members joined perpendicular to said plate, said cover support contacting said plate at said at least one said plurality of support.

12. The pit cover of claim 9 further comprising:

a plurality of support members joined perpendicular to said plate and wherein said support members resist displacement of said at least one rail member.

13. A pit cover for covering a pit defined by a foundation, the pit cover comprising:

a plate having a hole defining an area;

a block having a threaded hole therein, said block affixed to a bottom surface of said plate such that said threaded hole aligns with said area;

a plurality of support members joined perpendicular to said plate;

at least one rail member joined to said plate wherein said support members provide rigidity for the pit cover and resist displacement of said at least one rail member;

a support associated with the foundation;

a groove defined by one said pit cover or said support;

a protrusion defined by the other one of said pit cover or said support;

said groove narrowing from a first width towards a second width wherein the second width is less than the first width and said first width is disposed relative to the second width such that insertion of the protrusion into said groove causes an end of the protrusion to pass the first width prior to passing the second width;

said protrusion interacting with said groove such that said protrusion is guided towards an end of said groove to align the pit cover at a predetermined position relative to the foundation.

14. The pit cover of claim 13 further comprising:

a shoulder defined at an intersection between first and second sections of said block, said first section of said block having a diameter larger than the second section of said block;

said second section of said block inserted into the hole such that said shoulder contacts a bottom surface of said plate and wherein a diameter of the hole is larger than the second section of said block but smaller than the first section of said block.

15. The pit cover of claim 13 further comprising:

a second protrusion extending from said pit cover;

a second support affixed to said foundation, said second support defining a vertical section and a horizontal section;

an edge of said vertical section located at a first distance from an edge of said second section of said groove;

the first distance approximately equal to a second distance measured between said protrusion and said second protrusion such that insertion of said protrusion into said second section of said groove aligns an edge of said protrusion over said horizontal section such that said second protrusion rests on said horizontal section.

16. The pit cover of claim 13 further comprising an anchor threaded into the threaded hole, the anchor further affixed to a lifting device for removing the pit cover from the pit.

17. The pit cover of claim 13 further comprising:

a plurality of cover sections each cover section including at least one block;

one said plurality of cover sections said plate having two rail sections joined thereto.

18. The pit cover of claim 17 wherein said plurality of cover sections includes three cover sections;

a first one of said three cover sections having an first edge adjacent to a first one of said rail sections;

a second one of said three cover sections having an second edge adjacent a second one of said rail sections.

19. The pit cover of claim 18 wherein said first and second cover sections include machinery holes therein, said machinery holes sized such that a support can move through said machinery holes, said support affixed to machinery located in the pit.

20. A pit cover for covering a pit defined by a foundation, the pit cover comprising:

a plate;

a support section defining two opposing surfaces;

a first distance and a second distance smaller than said first distance and measured between the two opposing surfaces;

an interface section including an end such that when the pit cover is installed on the foundation, said end passes the first distance prior to passing the second distance and said end is disposed between said two opposing surfaces;

said interface section associated with one of said plate or the foundation and the support section associated with the other one of said plate or the foundation; and at least one rail member jointed to said plate, the rail member configured to receive a portion of a rail car thereon.

21. The pit cover of claim 20 wherein said support is associated with the foundation and the interface section is associated with said plate; and wherein a depth measured between said end and a top surface of the plate is approximately equal to a height measured between a bottom of said support and a top of the foundation.

22. The pit cover of claim 20 further comprising a groove, said two opposing surfaces defined by said groove.

23. The pit cover of claim 20 further comprising a plurality of support members joined to said plate and disposed perpendicular to said plate;

at least one said plurality of support members defining said interfacing section such that said end is defined by a surface of said at least one said plurality of support members.

24. The pit cover of claim 23 wherein the at least one rail member comprises two rail members.

25. The pit cover of claim 20 wherein said plate has a hole defining an area and further comprising a block having a threaded hole therein, said block affixed to a bottom surface of said plate such that said threaded hole aligns with said area.

* * * * *